US009526356B2

(12) United States Patent
Pichel et al.

(10) Patent No.: US 9,526,356 B2
(45) Date of Patent: Dec. 27, 2016

(54) PRODUCT DISPLAY SHELF

(71) Applicant: Display Technologies, LLC, Lake Success, NY (US)

(72) Inventors: Matthew Pichel, Englewood, NJ (US); Stephen Cummings, Rockaway Park, NY (US); Anthony Camello, Staten Island, NY (US)

(73) Assignee: Display Technologies, LLC, Lake Success, NY (US)

( * ) Notice: Subject to any disclaimer, the term of this patent is extended or adjusted under 35 U.S.C. 154(b) by 26 days.

(21) Appl. No.: 14/516,710

(22) Filed: Oct. 17, 2014

(65) Prior Publication Data

US 2016/0106234 A1 Apr. 21, 2016

(51) Int. Cl.

| | |
|---|---|
| ***A47F 5/08*** | (2006.01) |
| ***A47F 5/00*** | (2006.01) |
| ***A47F 3/04*** | (2006.01) |
| ***A47B 96/06*** | (2006.01) |

(52) U.S. Cl.

CPC ..... *A47F 5/08* (2013.01); *A47B 96/06* (2013.01); *A47F 3/0486* (2013.01); *A47F 5/0043* (2013.01)

(58) Field of Classification Search

CPC ..... A47F 5/08; A47F 5/0043; A47F 5/0068; A47F 5/0087; A47F 3/0404; A47F 7/283; A47F 3/0486; A47B 96/06

USPC ..... 211/150

See application file for complete search history.

(56) References Cited

U.S. PATENT DOCUMENTS

| | | | | | |
|---|---|---|---|---|---|
| 1,104,787 | A | | 6/1870 | Snow | |
| 2,350,523 | A | | 10/1886 | Bodley | |
| 376,825 | A | * | 1/1888 | Kent | E06C 7/14 248/211 |
| 1,299,575 | A | | 4/1919 | Holmes | |
| 1,483,035 | A | | 2/1924 | Wyatt | |
| 2,491,652 | A | | 12/1949 | Feerick | |
| 2,695,105 | A | | 11/1954 | Mitchell | |
| 2,908,468 | A | * | 10/1959 | Thomas | B44D 3/14 220/751 |
| 3,391,891 | A | | 7/1968 | Garden | |
| 3,429,542 | A | | 2/1969 | Fagan | |
| 4,286,717 | A | | 9/1981 | Liesinger | |
| 4,560,072 | A | | 12/1985 | Burrell | |
| 4,828,211 | A | | 5/1989 | McConnell et al. | |
| 4,899,895 | A | | 2/1990 | Espasandin et al. | |
| 4,972,923 | A | * | 11/1990 | Krause | E06C 7/16 182/121 |
| 5,078,281 | A | * | 1/1992 | Johnson | B25H 3/06 211/88.01 |
| 5,096,272 | A | | 3/1992 | Belokin, Jr. et al. | |
| 5,613,614 | A | | 3/1997 | Richardson | |
| 5,699,910 | A | * | 12/1997 | Kubat | B25H 5/00 206/373 |
| 5,836,043 | A | * | 11/1998 | Rovas | E06C 7/14 15/257.06 |

(Continued)

*Primary Examiner* — Korie H Chan

(74) *Attorney, Agent, or Firm* — Carter, DeLuca, Farrell & Schmidt, LLP

(57) ABSTRACT

A product display shelf including a product-supporting surface and at least one arm is disclosed. The at least one arm is disposed in mechanical cooperation with the product-supporting surface, and is movable from a first position where a securing surface of the at least one arm is facing proximally to a second position where the securing surface of the at least one arm is facing distally.

20 Claims, 4 Drawing Sheets

(56) References Cited

U.S. PATENT DOCUMENTS

| | | | | |
|---|---|---|---|---|
| 6,041,717 | A * | 3/2000 | Kubat | B60R 11/06 108/44 |
| 6,510,953 | B2 | 1/2003 | Daniels | |
| 7,004,334 | B2 | 2/2006 | Walsh et al. | |
| 7,306,106 | B2 | 12/2007 | Robertson | |
| 7,556,159 | B2 | 7/2009 | Robertson | |
| 7,913,964 | B1 * | 3/2011 | Kennedy | E06C 7/14 248/210 |
| 8,783,474 | B2 * | 7/2014 | Kuhlman | B60N 3/02 211/113 |
| 2003/0080078 | A1 * | 5/2003 | Belokin | A47F 3/0404 211/88.01 |
| 2006/0102570 | A1 | 5/2006 | Robertson | |
| 2006/0102572 | A1 | 5/2006 | Robertson | |
| 2008/0041803 | A1 | 2/2008 | Robertson | |
| 2009/0084739 | A1 | 4/2009 | Shock et al. | |
| 2009/0218454 | A1 * | 9/2009 | Stanley | F16M 13/00 248/121 |

* cited by examiner

PRODUCT DISPLAY SHELF

BACKGROUND

The present disclosure relates generally to product display shelves or merchandisers used on a door. More particularly, the present disclosure relates to a product display shelf for use on a door and includes arms configured to change the orientation of the product display shelf with respect to the door.

Shelves that are attachable to an interior of a door (e.g., a glass refrigerator or freezer door) are known in the art and are typically used to help maximize retail space and exposure. Additionally, shelves that are attachable to an exterior of a door (e.g., a glass refrigerator or freezer door) are also known in the art, and further help maximize retail space and exposure.

However, to enable retailers to maximize the potential of such shelves, the retailer often switches off using both types of shelves. That is, a retailer may use a first type of shelf that attaches to the interior of a door (e.g., to display products that require refrigeration), and the retailer may use a second type of shelf that attaches to the exterior of a door (e.g., to display products that do not require refrigeration). Thus, depending on what products a retailer wishes to display on a particular door, the retailer chooses to use either a shelf that attaches to the interior of the door, or a shelf that attaches to the exterior of the door.

SUMMARY

The present disclosure relates a product display shelf including a product-supporting surface and at least one arm. The at least one arm is disposed in mechanical cooperation with the product-supporting surface, and is movable from a first position where a securing surface of the at least one arm is facing proximally, to a second position where the securing surface of the at least one arm is facing distally.

In disclosed embodiments, the at least one arm includes a first arm and a second arm, and each of the first arm and the second arm is independently movable from a first position where the securing surface of the arm is facing proximally to a second position where the securing surface of the arm is facing distally. Here, it is disclosed that each of the first arm and the second arm is engagable with at least one securing structure. It is further disclosed that the securing structure includes a suction cup.

In disclosed embodiments, the product display shelf includes a distal surface extending upwardly from the product-supporting surface. Here, it is disclosed that the product display shelf includes a first side wall and a second side wall, with each side wall extending proximally from the distal surface. It is further disclosed that the at least one arm includes a first arm and a second arm, where the first arm is pivotable with respect to the first side wall, and where the second arm is pivotable with respect to the second side wall. Here, it is disclosed that the at least one arm includes a first arm and a second arm, each of the first arm and the second arm is independently movable from a first position where the securing surface of the arm is facing proximally to a second position where the securing surface of the arm is facing distally, and that each of the first arm and the second arm is engagable with at least one securing structure. Here, it is disclosed that the securing structure includes a suction cup. Here, it is further disclosed that each of the first arm and the second arm is pivotable with respect to the distal surface.

In disclosed embodiments, the product display shelf further includes a product-housing portion configured to substantially prevent products on the product-supporting surface from movement relative to the product-supporting surface upon movement of the product display shelf.

The present disclosure also relates to a method of displaying merchandise. The method includes positioning a securing surface of a product display shelf such that the securing surface faces proximally, engaging the securing surface of the product display shelf with an interior surface of a door, removing the product display from engagement with the interior surface of the door, moving the securing surface of the product display shelf such that the securing surface faces distally, and engaging the securing surface of the product display shelf with an exterior surface of the door.

In disclosed embodiments, engaging the securing surface of the product display shelf with the interior surface of the door includes the use of at least one suction cup. It is also disclosed that engaging the securing surface of the product display shelf with the exterior surface of the door includes the use of the at least one suction cup.

In disclosed embodiments, moving the securing surface of the product display shelf such that the securing surface faces distally includes pivoting the securing surface with respect to a product-supporting surface of the product display shelf.

In disclosed embodiments, the method includes positioning at least one product onto a product-supporting surface of the product display shelf. The disclosed method further includes positioning at least one product onto a product-supporting surface of the product display shelf when the product display shelf is engaged with the interior surface of the door.

BRIEF DESCRIPTION OF FIGURES

Various embodiments of the presently disclosed product display shelf are disclosed herein with reference to the drawings, wherein.

DETAILED DESCRIPTION

Figure 1:
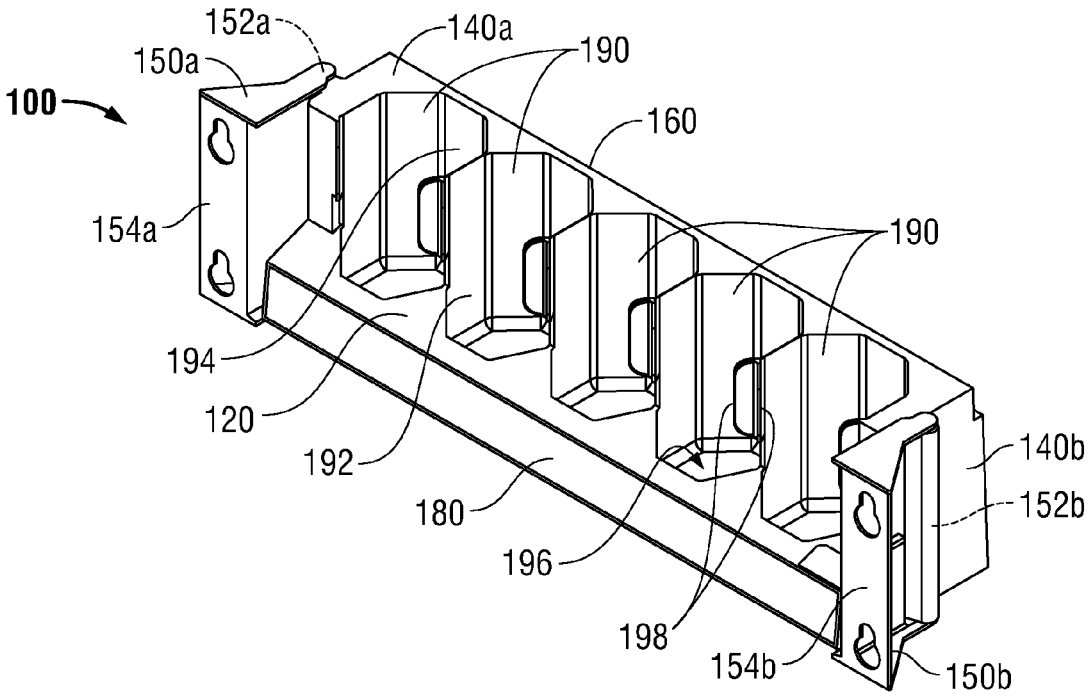
FIG. 1 is a perspective view of a product display shelf in a first orientation, in accordance with an embodiment of the present disclosure.

Embodiments of the presently disclosed product display shelf are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

In combination with the accompanying FIGS. 1-5, a product display shelf 100 of the present disclosure is described herein. Product display shelf 100 is configured to be removably attached to either an inner portion "IP" (or interior surface) or an outer portion "OP" (or exterior surface) of a vertical surface (e.g., a glass refrigerator or freezer door "D"). That is, the product display shelf 100 can be attached to a glass refrigerator door "D," for example, on either the inside or the outside of the refrigerator "R."

Shelf 100 includes a bottom surface 120, first and second side walls 140*a* and 140*b*, first and second pivotable arms 150*a* and 150*b*, a distal wall 160, a proximal portion 180, and a plurality of product-housing portions 190. Additionally, securing structures 200 (e.g., suction cups) are engagable with first and second pivotable arms 150*a* and 150*b* to facilitate the removable engagement between product display shelf 100 and vertical service or door "D."

Figure 2:
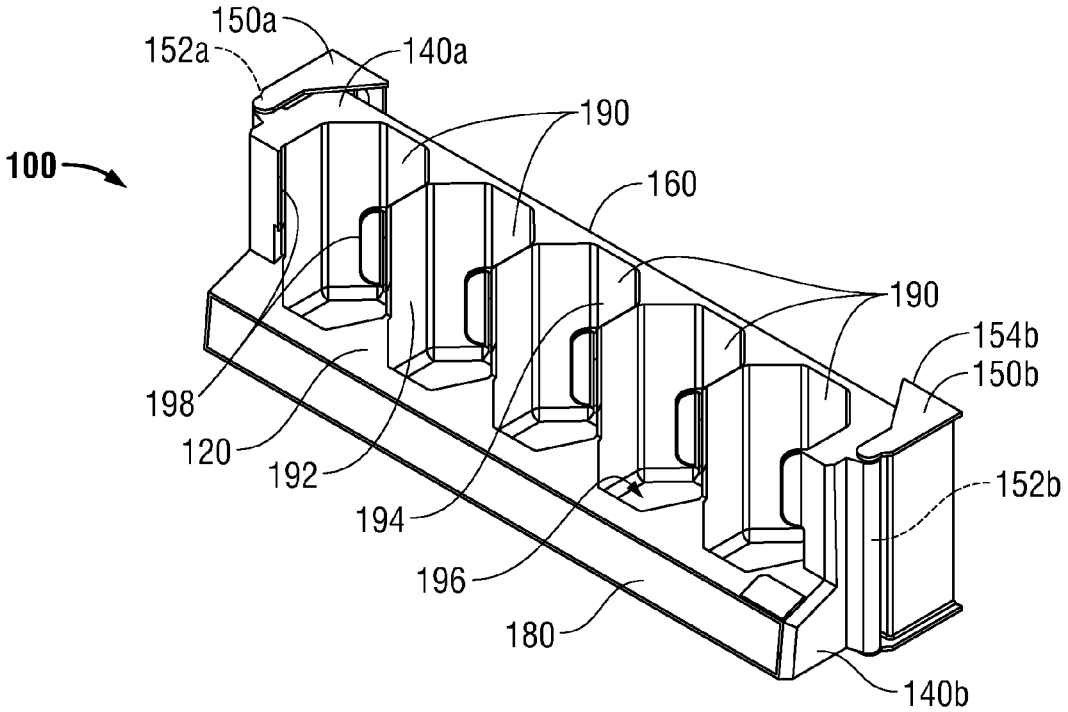
FIG. 2 is a perspective view of the product display shelf of FIG. 1 shown in a second orientation.
Figure 3:
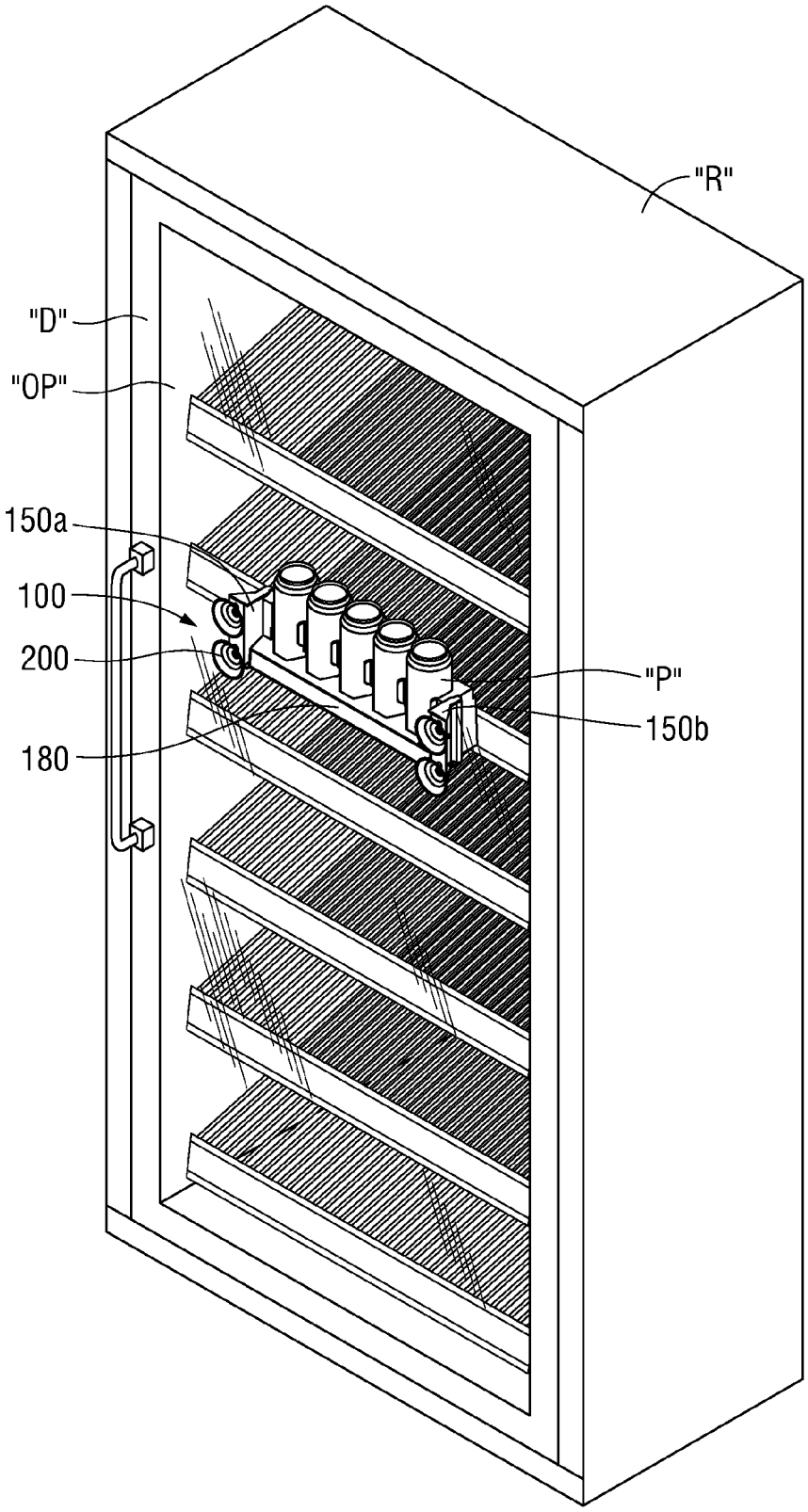
FIG. 3 is a perspective view of the product display shelf of FIGS. 1 and 2, shown in the first orientation supporting products and engaged with the inside of a door.
Figure 4:
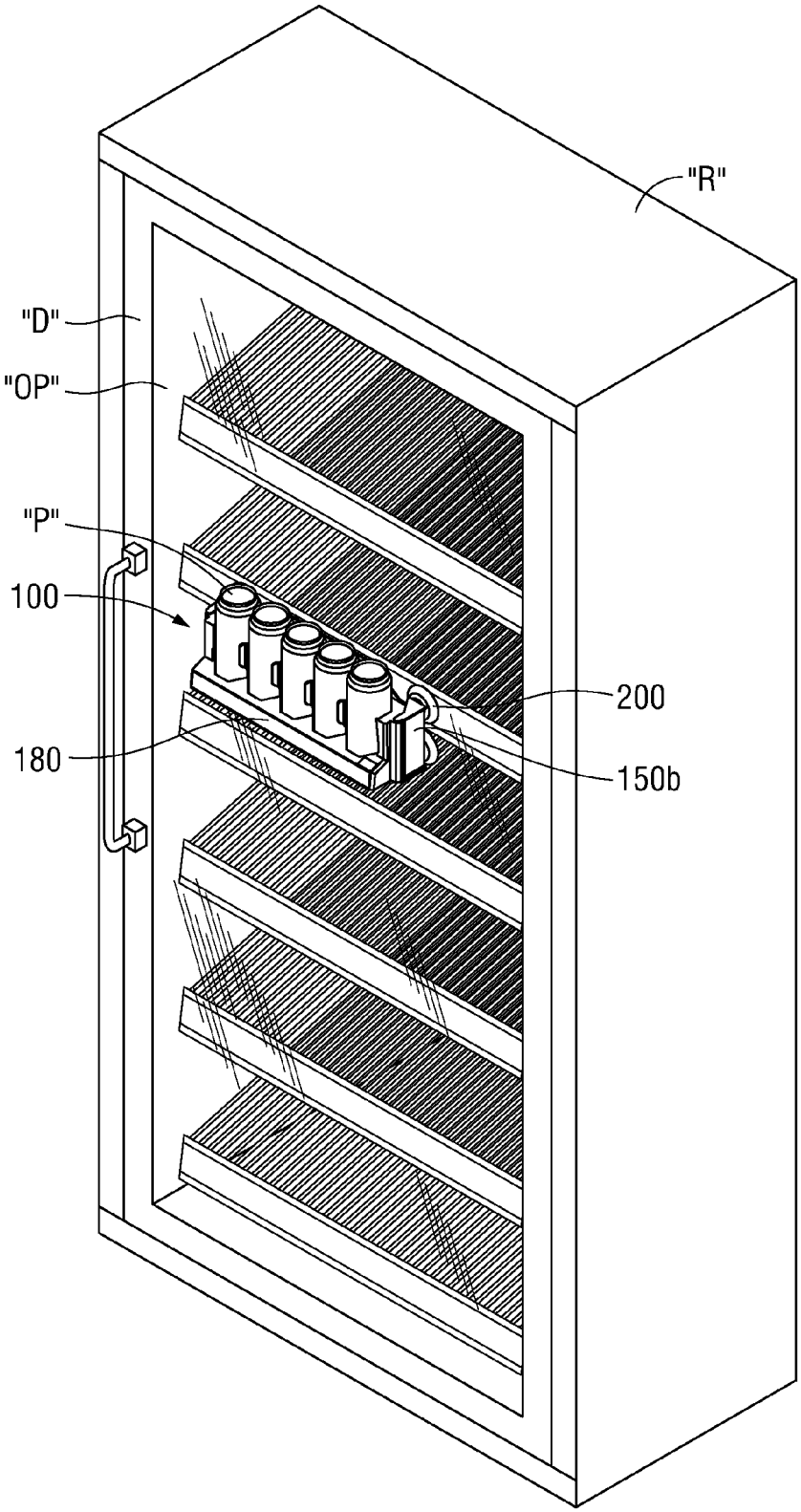
FIG. 4 is a perspective view of the product display shelf of FIGS. 1-3, shown in the second orientation supporting products and engaged with the outside of the door.
Figure 5:
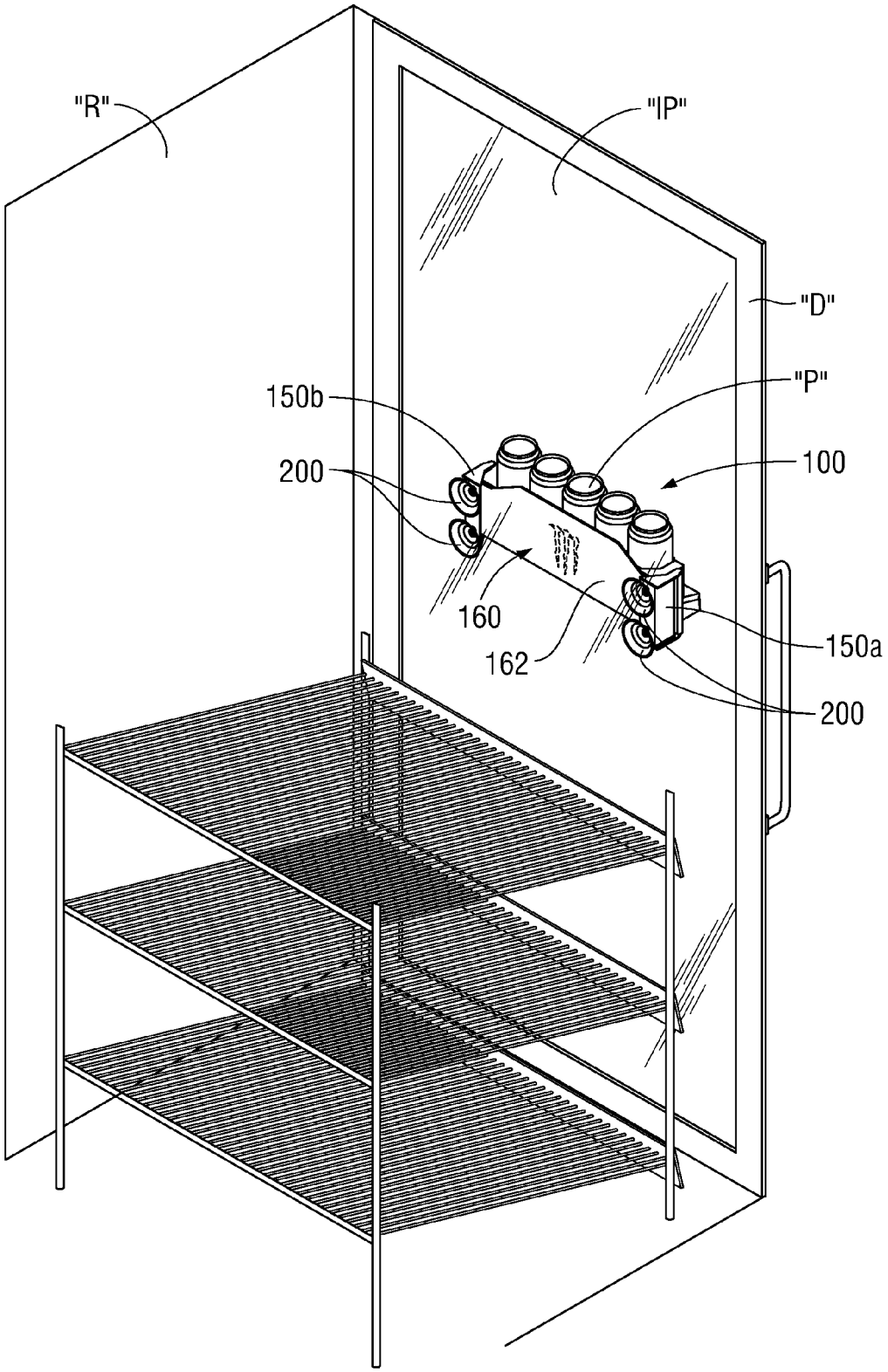
FIG. 5 is a rear perspective view of the product display shelf of FIGS. 1-4, shown in the second orientation supporting products and engaged with the outside of the door.

First and second pivotable arms 150*a* and 150*b* are pivotably engaged with respective side walls 140*a* and 140*b* about pivot pins 152*a* and 152*b*, respectively. The pivotable engagement between arms 150*a*, 150*b* and side walls 140*a*, 140*b* enables each arm 150*a*, 150*b* to pivot with respect to respective side wall 140*a*, 140*b* such that a securing surface 154*a*, 154*b* of respective arms 150*a*, 150*b* is movable between a first position where securing surfaces 154*a*, 154*b* are facing proximally (FIGS. 1 and 3), and a second position where securing surfaces 154*a*, 154*b* are facing distally (FIGS. 2, 4 and 5). Accordingly, when securing surfaces 154*a* and 154*b* are in their first position and facing proximally (FIGS. 1 and 3), product display shelf 100 is configured to engage the inner portion "IP" of vertical service or door "D" (e.g., positioned on the inside surface of a glass refrigerator door); when securing surfaces 154*a* and 154*b* are in their second position and facing distally (FIGS. 2, 4 and 5), product display shelf 100 is configured to engage the outer portion "OP" of vertical service or door "D" (e.g., positioned on the outside surface of a glass refrigerator door). As shown, in each of the first and second positions, the customer has a virtually unobstructed view of the product(s) "P" supported on product display shelf 100.

As shown in FIGS. 1-5, product display shelf 100 includes a plurality of product-housing portions 190. Product-housing portions 190 include partitions 192, rear surfaces 194, and wells 196, and are configured to substantially prevent products "P" that are on product display shelf 100 from movement relative to distal wall 160 upon movement of product display shelf 100 (e.g., refrigerator door "D" is opened and/or closed by a customer). That is, partitions 192 and rear surfaces 194 of product-housing portions 190 at least partially fill the otherwise empty space between adjacent products "P," between a product "P" and an adjacent side wall 140*a*, 140*b*, and between products "P" and distal wall 160 of product display shelf 100. Wells 196 of product-housing portions 190 may be configured for securing a specific product (e.g., a beverage can, a beverage bottle, a one-liter bottle, a two-liter bottle, etc.) having any regular or irregular shape with respect to product display shelf 100. Depending on the orientation of product display shelf 100, bottom surface 120 and/or wells 196 can support a product "P," and either may be referred to herein as a product-supporting surface.

Additionally, product-housing portions 190 include tabs 198 at a proximal portion thereof. Each set of two tabs 198 is configured to help prevent a product "P" from falling off of product display shelf 100 in a proximal direction. It is envisioned that at least some of the tabs 198 (e.g., all tabs 198) are flexible enough to allow a product "P" to be removed between a set of tabs 198 (e.g., when product display shelf 100 is secured to the outer portion "OP" of a vertical surface or refrigerator door "D"). It is further envisioned that at least some tabs 198 (e.g., all tabs 198) are rigid, and thus cannot flex with respect to the remainder of the product display shelf 100 to allow a product "P" to be removed therebetween. Here, products "P" can be removed by lifting the product "P" vertically, for example.

While the illustrated embodiments of product-housing portions 190 are of a particular shape, size and configured to support a particular number (five) of products "P," the present disclosure includes product-housing portions 190 that are of any shape, size and which are configured to support any number of products. Additionally, product-housing portions 190 may be configured to support a plurality of types/sizes of products "P" simultaneously. It is further envisioned that product-housing portions 190 are removable from the remainder of product display shelf 100 and are interchangeable with different product-housing portions 190, which, as can be appreciated, would increase the functionality of product display shelf 100. Here, product-housing portions 190 can be removable/replaceable using any suitable structure.

Additionally, at least part of product-housing portions 190 can be made from a compliant member to help maintain products "P" of different shapes/sizes on product display shelf 100. Additional details of a product display shelf including a compliant member are described in U.S. patent application Ser. No. 12/106,648 (U.S. Pat. No. 7,975,858), the entire contents of which being incorporated by reference herein.

With reference to FIGS. 1-4, proximal portion 180 extends below bottom surface 120 and is configured to display product information thereon. This positioning of proximal portion 180 allows maximum exposure of a product "P" supported by product display shelf 100, both when product display shelf 100 is engaged with the inner portion "IP" (FIG. 3) and the outer portion "OP" (FIGS. 4 and 5) of the vertical surface or door "D."

With reference to FIG. 5, a distal surface 162 of distal wall 160 can also be used to display product information. It is envisioned that distal wall 160 is configured to be shorter than the product(s) "P" supported by product display shelf 100 such that a consumer can view the portions of product(s) "P" extending above distal wall 160 when the consumer opens the refrigerator door "D," for example, either when product display shelf 100 is in its first or second position (FIGS. 3-5).

The present disclosure also includes a method of using product display shelf 100. The method includes positioning product display shelf 100 on the inner portion "IP" of vertical surface or door "D," positioning at least one product "P" on bottom surface 120 or well 196, removing product display shelf 100 from the inner portion 200*a* of the vertical surface or door "D," pivoting the arms 150*a*, 150*b* from the first position to the second position, positioning product display shelf 100 on the outer portion "OP" of the vertical surface 200, and/or positioning at least one product "P" on bottom surface 120 or well 196.

The present disclosure also includes a merchandising system including at least one product display shelf 100, and the vertical surface or door "D."

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of this disclosure.

The invention claimed is:

1. A product display shelf, comprising:

a product-supporting surface for supporting a product thereon;

a first arm disposed in mechanical cooperation with the product-supporting surface, the first arm being pivotable with respect to the product-supporting surface about a first axis disposed substantially perpendicular to the product-supporting surface from a first position to a second position, the first arm including a first securing surface, the first securing surface facing a first direction with the first arm in the first position and the first securing surface facing a second direction with the first arm in the second position, wherein the first direction is opposite from the second direction; and a second arm pivotable with respect to the product-supporting surface about a second axis disposed substantially perpendicular to the product-supporting surface between a first position and a second position, the second arm having a second securing surface, the second securing surface faces the first direction with the second arm in the first position and faces the second direction with the second arm in the second position, the first arm movable independently of the second arm.

2. The product display shelf according to claim 1, wherein each of the first arm and the second arm is engagable with at least one securing structure.

3. The product display shelf according to claim 2, wherein the at least one securing structure includes a suction cup.

4. The product display shelf according to claim 1, further comprising a supporting wall extending upwardly from the product-supporting surface.

5. The product display shelf according to claim 4, further comprising a first side wall and a second side wall, each side wall extending from the supporting wall.

6. The product display shelf according to claim 5, further comprising a second arm, wherein the first arm is pivotable with respect to the first side wall and the second arm is pivotable with respect to the second side wall.

7. The product display shelf according to claim 6, wherein the second arm is movable between a first position and a second position, the second arm having a second securing surface, the second securing surface faces the first direction with the second arm in the first position and faces the second direction with the second arm in the second position, the first arm pivotable independently of the second arm, and each of the first and second arms engagable with at least one securing structure.

8. The product display shelf according to claim 7, wherein the at least one securing structure includes a suction cup.

9. The product display shelf according to claim 8, wherein each of the first arm and the second arm is pivotable with respect to the supporting wall.

10. The product display shelf according to claim 1, further comprising a product-housing portion configured to substantially prevent products on the product-supporting surface from movement relative to the product-supporting surface upon movement of the product display shelf.

11. A method of displaying merchandise, the method comprising:

positioning a securing surface of a product display shelf such that the securing surface faces a first direction;

engaging the securing surface of the product display shelf with an interior surface of a door;

removing the product display shelf from engagement with the interior surface of the door;

pivoting the securing surface of the product display shelf with respect to a product-supporting surface of the product display shelf about a first axis disposed substantially perpendicular to the product-supporting surface such that the securing surface faces a second direction, wherein the first direction is opposite from the second direction; and engaging the securing surface of the product display shelf with an exterior surface of the door.

12. The method according to claim 11, wherein engaging the securing surface of the product display shelf with the interior surface of the door includes the use of at least one suction cup.

13. The method according to claim 12, wherein engaging the securing surface of the product display shelf with the exterior surface of the door includes the use of the at least one suction cup.

14. The method according to claim 11, further comprising positioning at least one product onto the product-supporting surface of the product display shelf.

15. The method according to claim 11, further comprising positioning at least one product onto the product-supporting surface of the product display shelf when the product display shelf is engaged with the interior surface of the door.

16. The method according to claim 15, further comprising positioning at least one product onto the product-supporting surface of the product display shelf when the product display shelf is engaged with the exterior surface of the door.

17. The product display shelf according to claim 1, wherein the first direction is 180° apart from the second direction.

18. The product display shelf according to claim 1, wherein the first arm is physically prevented from being able to pivot 360° with respect to the product-supporting surface.

19. A product display shelf, comprising:

a product-supporting surface for supporting a product thereon;

a first arm disposed in mechanical cooperation with the product-supporting surface, the first arm being pivotable with respect to the product-supporting surface about a first axis disposed substantially perpendicular to the product-supporting surface from a first position to a second position, the first arm including a first securing surface, the first securing surface facing a first direction with the first arm in the first position and the first securing surface facing a second direction with the first arm in the second position, wherein the first direction is opposite from the second direction;

a supporting wall extending upwardly from the product-supporting surface;

a first side wall extending from the supporting wall;

a second side wall extending from the supporting wall; and a second arm, wherein the first arm is pivotable with respect to the first side wall, and wherein the second arm is pivotable with respect to the second side wall.

20. The product display shelf according to claim 19, wherein the second arm is movable between a first position and a second position, the second arm having a second securing surface, the second securing surface faces the first direction with the second arm in the first position and faces the second direction with the second arm in the second position, the first arm pivotable independently of the second arm, and each of the first and second arms engagable with at least one securing structure.

* * * * *